United States Patent [19]

Mimura et al.

[11] Patent Number: 4,917,512

[45] Date of Patent: Apr. 17, 1990

[54] APPARATUS FOR AUTOMATICALLY ADJUSTING A GAP BETWEEN A PLATEN AND A PRINT HEAD

[75] Inventors: Takao Mimura; Atsushi Nishizawa; Masayuki Kumazaki, all of Suwa, Japan

[73] Assignee: Seiko Epson Corporation, Tokyo, Japan

[21] Appl. No.: 303,501

[22] Filed: Jan. 27, 1989

[30] Foreign Application Priority Data

Jan. 28, 1988 [JP] Japan ..... 63-18115
Jan. 29, 1988 [JP] Japan ..... 63-18797

[51] Int. Cl.[4] ..... B41J 11/20

[52] U.S. Cl. ..... 400/56; 400/708; 226/45; 271/263

[58] Field of Search ..... 400/56, 708, 708.1; 271/262, 263; 226/45; 100/47

[56] References Cited

U.S. PATENT DOCUMENTS

| | | | |
|---|---|---|---|
| 4,088,215 | 5/1978 | Bader | 400/56 |
| 4,354,766 | 10/1982 | Hendrischk et al. | 400/708 |
| 4,632,577 | 12/1986 | Brull et al. | 400/56 |
| 4,652,153 | 3/1987 | Kotsuzumi et al. | 400/56 |
| 4,676,675 | 6/1987 | Suzuki et al. | 400/56 |
| 4,702,629 | 10/1987 | Hamano et al. | 400/56 |
| 4,720,200 | 1/1988 | Gomoll et al. | 400/56 |

FOREIGN PATENT DOCUMENTS

| | | | |
|---|---|---|---|
| 8278 | 1/1981 | Japan | 400/56 |
| 163588 | 10/1982 | Japan | 400/56 |
| 173175 | 10/1982 | Japan | 400/56 |
| 7076 | 1/1984 | Japan | 400/56 |
| 54583 | 3/1984 | Japan | 400/56 |
| 270177 | 11/1986 | Japan | 400/56 |

OTHER PUBLICATIONS

Carpenter et al., "Forms Sensor for Automatic Platen", IBM Tech. Discl. Bulletin, vol. 13, No. 12, p. 3643, 5-71.

Frechekle, "Automatic Impression Control", Xerox Disclosure Journal, vol. 1, No. 7, p. 31, 7-76.

*Primary Examiner*—Eugene H. Eickholt
*Attorney, Agent, or Firm*—Blum Kaplan

[57] ABSTRACT

A mechanism for automatically adjusting the gap between the platen and print head of a printer includes a paper thickness lever detecting lever pivotably mounted on the printer base so that one end selectively contacts the surface of the platen. The opposite end of the lever contacts a pressure sensitive conductive member or adjusts the amount of light striking a photosensitive member of a paper thickness detector to generate an initial signal. After paper is fed onto the platen the lever contacts the surface of the paper and the paper thickness detector generates a second paper thickness signal corresponding to the different position of the lever. A carriage control circuit receives this signal and controls a print head carriage guide to adjust the relative position between the carriage and the platen to provide a suitable distance for printing.

17 Claims, 6 Drawing Sheets

APPARATUS FOR AUTOMATICALLY ADJUSTING A GAP BETWEEN A PLATEN AND A PRINT HEAD

BACKGROUND OF THE INVENTION

The present invention relates to a mechanism for adjusting the gap between a platen and print head in a printer, and in particular, to an apparatus for adjusting the gap between the platen and print head in response to an output from a paper thickness detector.

Generally, the print density of wire dot impact printers or thermal transfer printers changes in accordance with the gap between a print head and print paper. Therefore, the newest prior art printers detect the thickness of the print paper and move the carriage on which the print head is mounted to adjust the gap between the print head and print paper and optimize print density.

A conventional printer which adjusts the gap between the print head and the print paper is shown in Japanese Patent Laid-Open Application No. 2344872/85 in which a printer includes a pressure sensitive element secured to a carriage. The carriage is movable in a direction orthogonal to the length of the platen. An electric signal indicating the thickness of the print paper is generated by the pressure sensitive element in response to movement of the carriage and the gap between the print head and the platen is automatically adjusted in response to the electric signal.

This device has been satisfactory, however when the thickness of the print paper is detected, the platen must be moved in the vertical direction relative to the print head so that the response speed is low. Additionally, because the relative position between the platen and print head is detected through movement of carriage, measuring errors due to movement of the carriage may be generated when detecting thickness of the print paper. Accordingly, the prior art device suffers from an inferior reliability in adjusting the gap.

Accordingly, it is desirable to provide a mechanism for automatically adjusting the gap between the platen and print head in a printer which overcomes the shortcomings of the prior art.

SUMMARY OF THE INVENTION

A printer including an apparatus for measuring the thickness of the print medium and a mechanism for adjusting the gap between the print head and platen in response to that measurement is provided. The apparatus for measuring the thickness includes a lever which selectively contacts the surface of the platen when there is no print medium to generate a first reference signal and selectively contacts the print medium to generate a second reference signal. A detecting circuit connected to the lever detects the difference in signals to determine thickness and generates a signal to adjust the gap between the print head and platen dependent upon the determined thickness.

The detecting circuit may include a light emitting element and photosensitive element optically coupled to the light emitting element. When the lever is displaced it controls the amount of light which is received by the photosensitive element so that the amount of light detected by the photosensitive element changes in accordance with the distance between the platen and the lever. Thereby, the thickness of the print paper changes the amount of light detected. Alternatively, the lever is operatively coupled to an elastic pressure sensitive conductive member for generating the comparative signals.

Accordingly, it is an object of the invention to provide an improved mechanism for automatically adjusting the gap between the platen and the print head in a printer.

Another object of the invention is to provide an apparatus for adjusting the gap between a platen and a print head in a printer which is highly reliable.

A further object of the invention is to provide an apparatus which more accurately measures the thickness of a print medium within the printer.

Yet another object of the invention is to provide an apparatus for detecting the thickness of print medium which is easily assembled.

Yet a further object of the invention is to provide an apparatus for adjusting the gap between the print head and platen automatically in response to the thickness determination.

Still other objects and advantages of the invention will in part be obvious and will in part be apparent from the specification.

The invention accordingly comprises the features or construction, combinations of elements, and arrangements of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
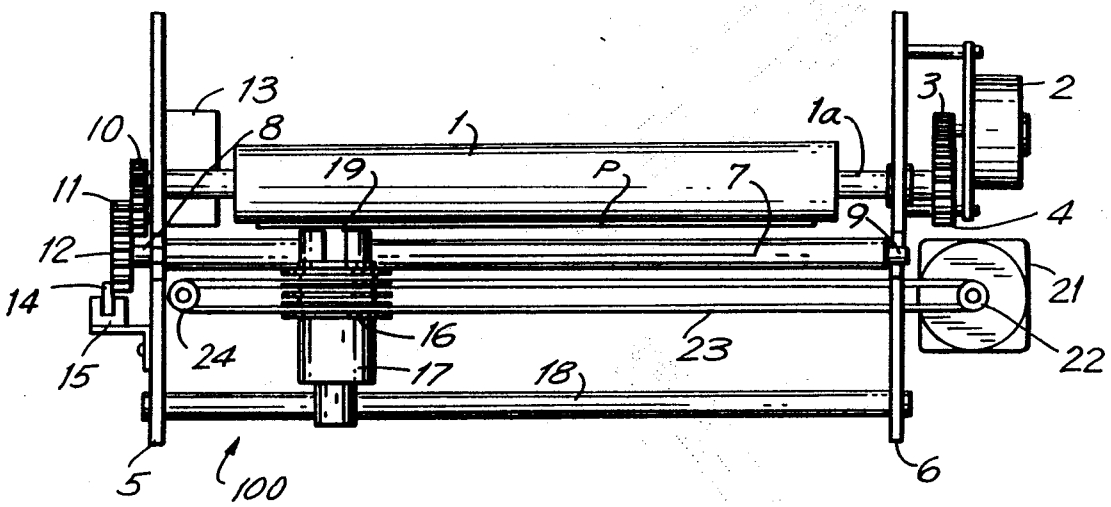
FIG. 1 is a top plan view of a printer constructed in accordance with the invention.
Figure 2:
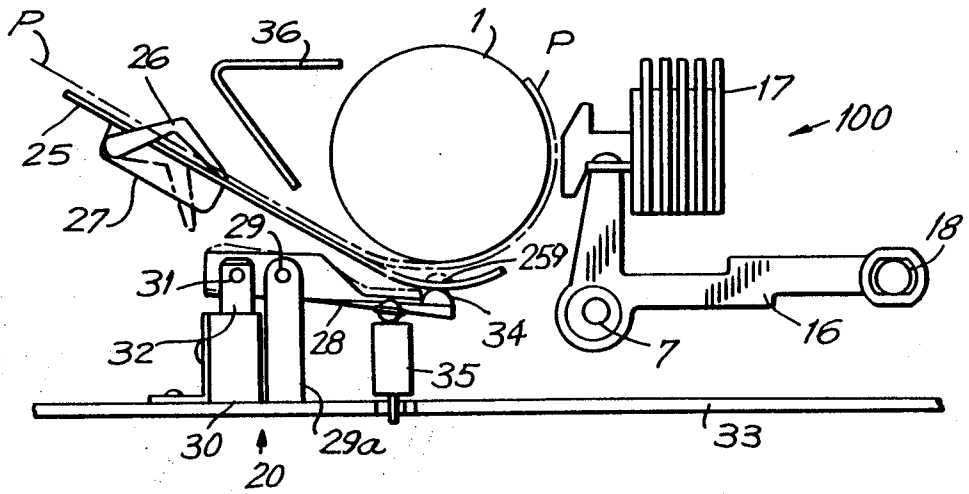
FIG. 2 is a left side elevational view of the print head and platen of the printer of FIG. 1.

Reference is made to FIGS. 1 and 2 wherein a printer generally indicated at 100, constructed in accordance with the invention is shown. Printer 100 includes a right frame wall 5 and a left frame wall 6. A platen 1 is rotatably supported between frame walls 5 and 6 on a platen shaft la. A paper feeding motor 2 is mounted on frame wall 6 and is operatively connected to platen 1 through a driving pinion gear 3 and a transmitting gear 4 for rotating platen 1. A carriage guide shaft 7 is supported between frame walls 5 and 6 parallel to platen 1 in a position in front of motor 2. A second guide shaft 18 is supported between frame walls 5 and 6 parallel to guide shaft 7. Carriage guide shaft 7 rotates within holes 8 and 9 of respective frame walls 5 and 6 in an eccentric manner as shown in FIG. 2.

A gap adjusting gear 12 is secured at one end of carriage guide shaft 7 outside of frame wall 5. Gap adjusting gear 12 meshes with a transmitting gear 11 which in turn engages a driving gear 10 to connect gap adjusting gear 12 to a gap adjusting motor 13 mounted on frame wall 5. A photosensor 15 mounted on frame wall 5 includes a light emitting element and photosensitive element. A positional detecting plate 14 is mounted on the outside surface of adjusting gear 12 to displace gear 12 by a rotational amount in response to a light input. The photosensitive element of photosensor 15 changes the rotational direction of detecting plate 14 by producing electric signal in response to the light received by the photosensitive element.

A print head carriage 16 is slidably supported on guide shaft 7 and second guide shaft 18 for reciprocal displacement along the length of platen 1. A print head 17 is mounted on carriage 16 which is operatively connected to a timing belt 23. A pinion gear 22 is driven by a carriage drive motor 21 mounted outside frame wall 6. Timing belt 23 is mounted about pinion gear 23 and an idler roller 24 at frame wall 5. Carriage 16 is reciprocally moved along the length of shaft 7 by timing belt 23. Carriage 17 is also movable in the vertical direction relative to platen 1 when guide shaft 7 is pivotably rotated.

Printer 100 includes a paper guide plate 25 for guiding paper along a paper path about platen 1. A paper presence detector 27 is mounted on guide plate 25 and includes a pivotally mounted depressible lever 26 for sending a signal when depressed by incoming paper P. A paper guide 36 is positioned above paper guide plate 25 to aid in loading paper onto guide plate 25.

A paper thickness detector, generally indicated at 20, is mounted on a frame base or substrate 33. Paper thickness detector 20 includes an elongated paper thickness detecting lever 28 which is pivotably mounted to a shaft 29 supported on base 33 by a projecting arm 29*a*. At one end of lever 28 a contact portion 34 projects through a window 25*a* formed in paper guide plate 25 and the opposite end of lever 28 is coupled by a pin 31 to a plunger 32 driven by a solenoid 30 mounted on base 33. A gap detector is provided at the rear side of paper thickness detecting lever 28. A spring 35 supported on base 33 biases lever 28 away from platen 1 in the region of window 25*a* in paper guide plate 25.

Figure 3:
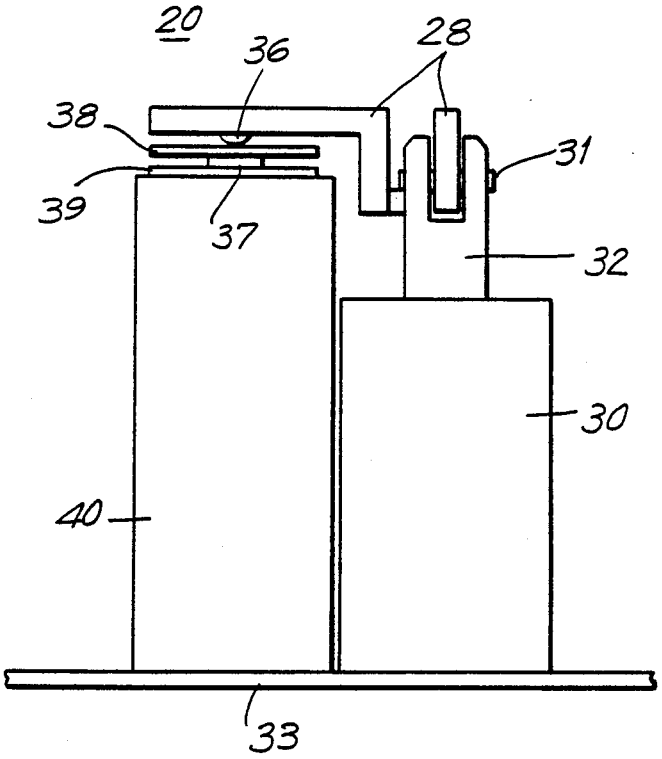
FIG. 3 is a side elevational view of a paper thickness detector constructed in accordance with one embodiment of the invention.

Reference is now made to FIG. 3 wherein paper thickness detector 20 constructed in accordance with one embodiment of the invention is shown in detail. A pressure sensitive element 37 between a first protective plate 38 and a second protective plate 39 is positioned on a mount 40 supported on base 33. Pressure sensitive element 37 is a pressure sensitive conductive rubber in which the electric resistance changes in accordance with pressure applied from the exterior and protective plate 39 acts as an electrode. A pressure member 36 projecting from paper thickness detecting lever 28 contacts protective plate 38 bringing it in contact with pressure sensitive element 37. Accordingly, as paper thickness detecting lever 28 moves in accordance with the thickness of paper P, varying pressure is applied to pressure sensitive element 37 providing a signal corresponding to the thickness of paper P.

Figure 4:
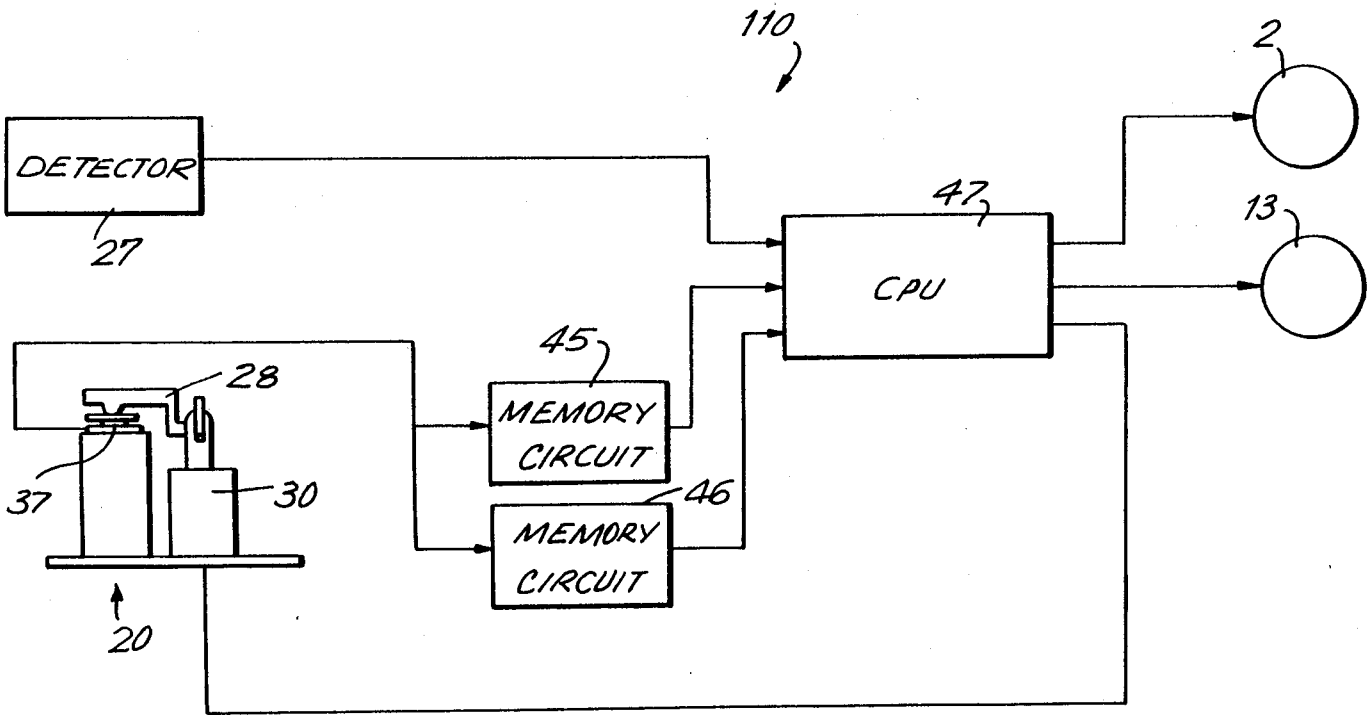
FIG. 4 is a block diagram of a control circuit for controlling the printer in accordance with an embodiment of the invention.

A first embodiment of a gap controlling circuit, generally indicated at 110, is shown in FIG. 4. A first memory circuit 45 and a second memory circuit 46 receive the output from pressure sensitive element 37. These inputs to memory circuits 45 and 46 are stored therein as first and second thickness signals, respectively and both signals are output to a CPU 47. CPU 47 receives inputs from memory circuit 45, memory circuit 46 and paper detector 27 and adjusts the ga between platen 1 and print head 17 by providing output control signals to paper feeding motor 2, gap adjusting motor 13 and solenoid 30.

The gap between print head 17 and platen 1 is initially adjusted by pivotably rotating carriage guide shaft 7 so that the gap between platen 1 and print head 17 or the gap between platen 1 and carriage 16 is set as a reference value. Under this condition, photosensor 15 and position detecting plate 14 are moved relative to each other to adjust the gap between print head 17 and the surface of platen 1 at a proper predetermined value. The adjusted position of print head 17 and the surface of platen 1 is the reference position.

At this position, paper thickness detecting lever 28 is moved by adjusting plunger 32 of solenoid 30 so that contacting portion 34 of lever 28 contacts the surface of platen 1. Simultaneously, pressure sensitive element 37 is compressed by pressure member 36 to a pressure value which corresponds to the distance between contact portion 34 of lever 28 and the surface of platen 1. A corresponding electronic signal is generated by paper thickness detector 20 as a result of the compression of pressure sensitive element 37. The electronic signal is input to memory circuit 45 to be stored as an initializing value.

Figure 5:
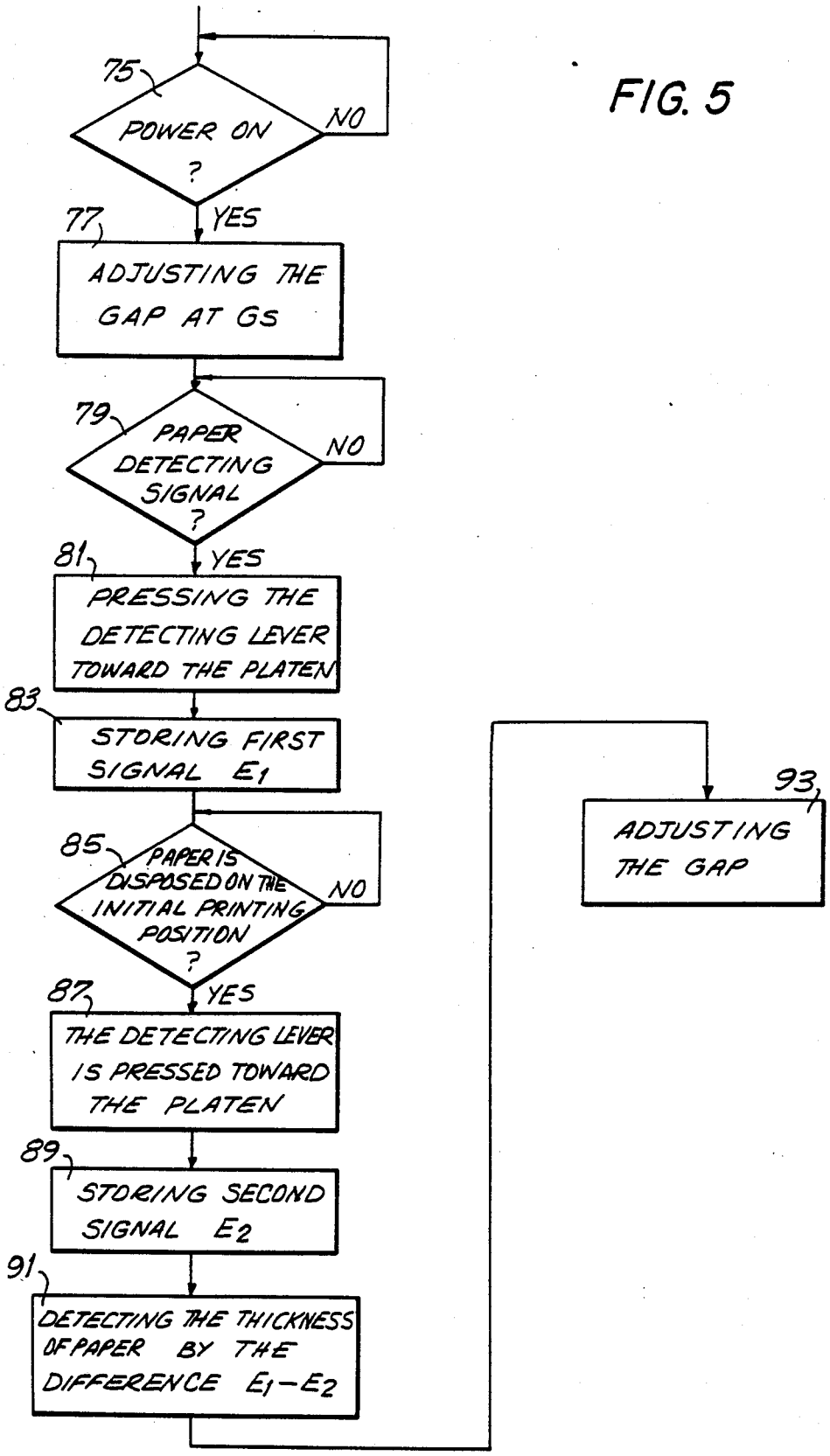
FIG. 5 is a flow chart showing the operation of the printer of FIG. 1 in accordance with the invention.

Reference is now made the flow chart of FIG. 5 to explain the steps for adjusting the gap between print head 17 and platen 1 in accordance with the invention. Printer 100 is turned on in accordance with a first step 75 and motor 13 pivotably rotates eccentric guide shaft 7 moving print head 17 in a vertical direction relative to the surface of platen 1. This position becomes the reference gap Gs corresponding to the reference position of detecting plate 14 signified by a signal output by photosensor 15 stopping the rotation of the motor in accordance with a step 77.

When print head 17 is in this condition, print paper is loaded in printer 100 between paper guide plate 25 and paper guide 36. Detecting lever 26 is pushed down and paper detector 27 outputs a paper detect signal in accordance with a step 79. Upon receiving the signal, output by paper detector 27 solenoid 30 is energized by CPU 47 and contact portion 34 of detecting lever 28 is urged towards the surface of platen 1 contacting platen 1 in accordance with a step 81. Accordingly, a compression signal El which corresponds to the signal output when there is no print paper P present within printer 100, i.e. first signal El indicative of the reference gap distance Gs s output and stored in memory circuit 45 in accordance with a step 83.

When initial signal E1 is output, solenoid 30 is denergized and detecting lever 28 which is pressed against platen 1 is released and pulled away from platen 1 by spring 35. CPU 47 then generates a signal to paper feeding motor 2 to advance print paper P.

When print paper P is loaded at the initial printing position in accordance with a step 85, solenoid 30 is again energized by CPU 47 and contact portion 34 of detecting lever 28 is pressed towards platen 1 in accordance with a step 87. In this condition, print paper P is positioned on the surface of platen 1 so that contact portion 34 of lever 28 is now farther away from platen 1 by a thickness D of print paper P from the position of contact portion 34 when print paper P is not present. A second signal E2 corresponding to the compression of pressure sensitive element 37 produced by lever 28 contacting paper P on platen 1 is output and stored in second signal memory circuit 46 in accordance with a step 89.

The difference between the first and second signals, corresponding to the thickness of print paper P is shown in the following equation:

$$E1-E2=\Delta D.$$

CPU 47 calculates Δ D of print paper P in accordance with this equation in a step 91. CPU 47 controls the rotation of gap adjusting motor 13 to produce a predetermined relation between the thickness of print paper P and the gap between platen 1 and print head 17. Eccentric guide shaft 7 is pivotably rotated and moves carriage 16 in the vertical direction relative to platen 1 due to the eccentricity of guide shaft 17 so that the gap between print head 17 and platen 1 is adjusted to best suit the thickness D of print paper P in accordance with a step 93.

Figure 6:
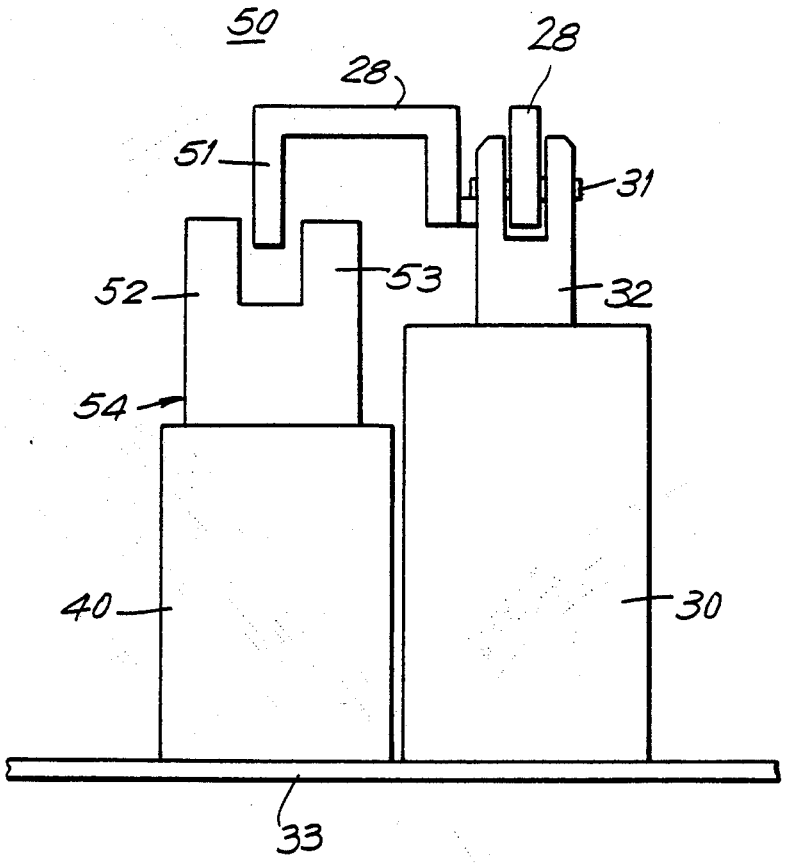
FIG. 6 is a side elevational view of a second embodiment of a paper thickness detector constructed in accordance with the invention.

Reference is now made to FIG. 6 in which a second embodiment of a paper thickness detecting mechanism generally indicated at 50 constructed in accordance with the invention is shown. Like numerals are used to indicate like parts in paper thickness detecting mechanism 20 of FIG. 3. Paper thickness detecting mechanism 50 includes a distance detector 54 which has a light emitting element 52 and a photosensitive element 53. A light shutting plate 51 extending from paper thickness detecting lever 28 moves between photosensitive element 53 and light emitting element 52 in accordance with the movement of lever 28. Accordingly, different amounts of light are received by photosensitive element 53 depending upon the position of lever 28 which in turn is displaced by the thickness of paper P.

Figure 7:
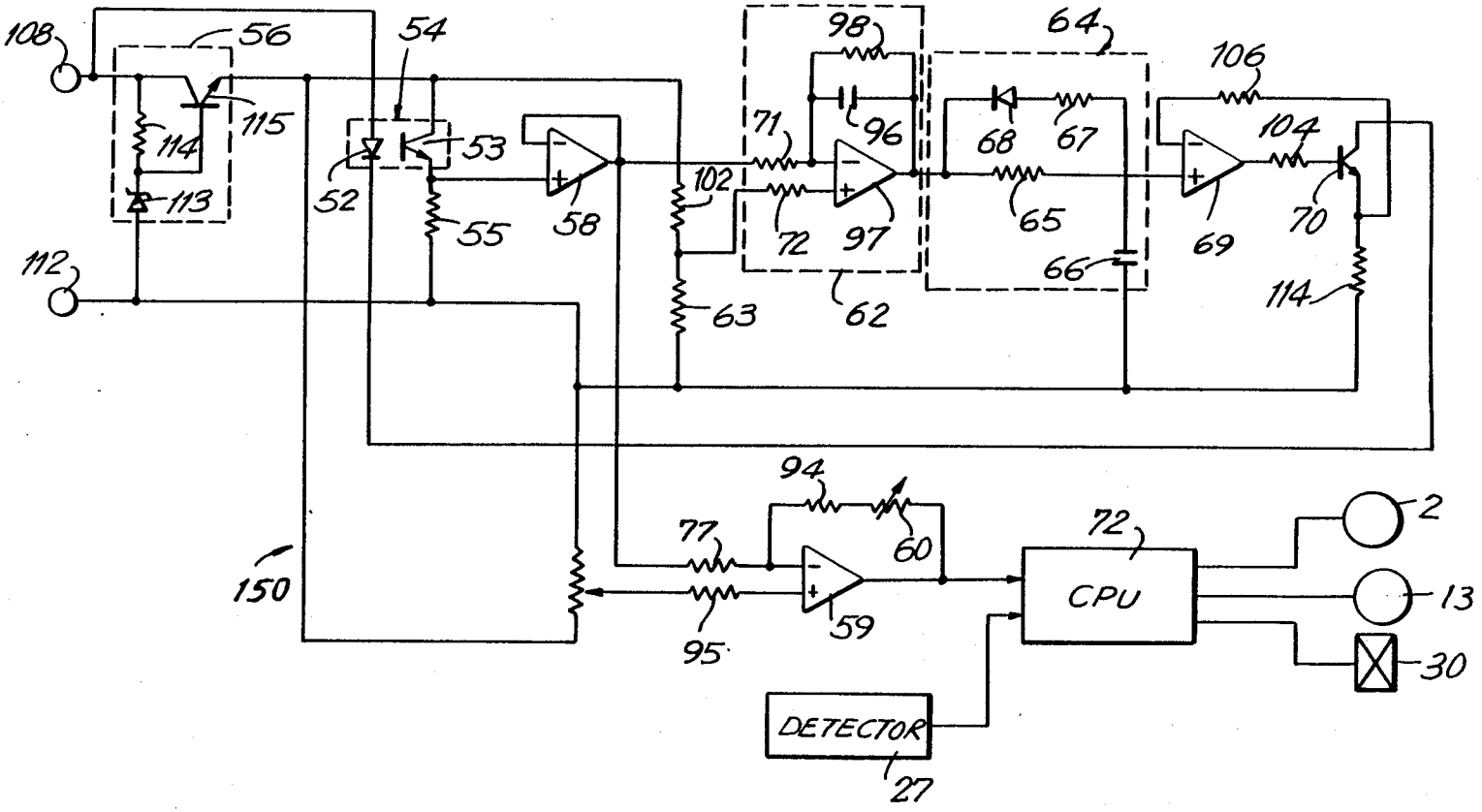
FIG. 7 is a circuit diagram of a circuit for controlling the printer in accordance with the second embodiment of the invention.

A circuit generally indicated at 150 for controlling the gap in accordance with paper thickness detector 50 is shown in FIG. 7. Distance detector 54 is connected to a voltage adjusting circuit 56 through photosensitive element 53 and a resistor 55. The output photosensitive element 53 is input to an operational amplifier 59 through a buffer amplifier 58 and a resistor 77. Light emitting element 52 of distance detector 54 is a light emitting diode and photosensitive element 53 is a transistor. Voltage adjusting circuit 56 includes a diode 113, a resistor 114 and a transistor 115.

Because a signal from buffer amplifier 58 is input into a non-reversal input terminal, a variable resistor 60 in series with a resistor 94 is provided across operational amplifier 59. A zero point adjusting voltage is input to operational amplifier 59 through a reference voltage generator 61 and a second resistor 95.

A light detecting circuit 62 detects the amount of light received by photosensitive element 53 represented by the signal output by buffer amplifier 58. Light detecting circuit 62 includes an operational amplifier 94 receiving inputs through resistors 71, 72. Amplifier 96 is in parallel with a capacitor 96 and a resistor 98. Light detecting circuit 62 provides an output to a time constant setting circuit 64.

Time constant setting circuit 64 includes a high resistor 65, a capacitor 66, a low resistor 67 having a resistance value one one hundredth the resistance value of resistor 65 and a diode 68 which conducts in response to a reversal of the output of light detecting circuit 62. Low resistor 67 is connected in series with diode 68. The DC circuit includes low resistor 67 and diode 68 connected in parallel to high resistor 65.

A light emitting element output adjusting circuit 69 provides an input to transistor 70 through a resistor 104 and receives a feedback input to its negative terminal from transistor 70 through a resistor 106. Transistor 70 receives an input from terminals 108, 112 through a resistor 114. Time constant setting circuit 64 stops the operation of light emitting element output adjusting circuit 69 during detection of the thickness of the print paper and then restores the voltage at the initial value immediately after the paper thickness has been detected and detecting lever 28 is restored to its initial position making it possible to begin the next operation.

Light emitting element output adjusting circuit 69 acts to control transistor 70 in response to circuit 64 to detect the amount of light and adjust the current applied to light emitting diode 52 of distance detector 54 making it possible to obtain a regular reference value of the signal emitted from transistor 53.

The input to the positive terminal of operational amplifier 94 is provided by a voltage divider formed by resistors 63 and 102.

The initial adjustment of paper thickness detecting mechanism 50 constructed in accordance with the second embodiment of the invention is as follows. Contacting portion 34 of paper thickness detecting lever 28 is brought into contact with platen 1 by operating solenoid 30. A minimum amount of light is transmitted from light emitting element 52 of distance detector 54 to photosensitive element 53. A light amount adjusting resistor 63 is provided to output a predetermined sensor value and zero period adjusting circuit 61 is provided to output a signal having a predetermined value.

Eccentric guide shaft 7 pivotably rotates so that the gap between platen 1 and print head 17 or the gap between platen 1 and carriage 16 is set at a reference value using a gauge or the like. In this condition, photosensor 15 and position detecting plate 14 move relative to each to adjust the gap between print head 17 and platen 1 to a predetermined distance as described above. This predetermined distance is the reference position.

When paper P having a predetermined thickness is inserted, paper thickness detecting lever 28 is pivoted towards platen 28 by solenoid 30 so that contact portion 34 of lever 28 is brought into contact with the surface of print paper P having a predetermined thickness. Because light shutting plate 51 is positioned in response to the position of contact portion 34 on the surface of print paper P the amount of light corresponding to paper of a predetermined thickness is input to photosensitive element 53 of distance measuring element 54 which acts as a thickness detector. An incline adjusting resistor 61 is then adjusted to generate an output signal corresponding to the predetermined thickness of the print paper.

The gap between print head 17 and platen 1 is adjusted by operation of motor 13. Eccentric guide shaft 7 is pivotably rotated so that carriage 16 is moved vertically relative to the surface of platen 1. Print head 17 is moved to a position in which the distance between print head 17 and the surface of platen 1 is the distance of a reference gap Gs and position detecting plate 14 reaches a predetermined reference position. Signals are output by photosensor 15 and rotation of the motor is stopped.

In this condition, print paper P is then inserted along paper guide 25 deflecting detecting lever 25 causing paper detector 27 to produce a paper detecting signal. Upon the input of this signal CPU 72 operates motor 2 to feed print paper P to an initial printing position.

Once print paper P is inserted and positioned at the initial printing position, CPU 72 energizes solenoid 30 to push. detecting lever 28 towards platen 1 so that contact portion 34 contacts print paper P. Light shutting plate 51 is moved upward out of distance measuring elements 54 by the value D corresponding to the thickness of print paper P to a maximum value of emitted light and is stopped allowing a signal to be output in proportion to the thickness of print paper P from photosensitive element 53.

Because upward movement of light shutting plate 51 results in an increase in the amount of light striking photosensitive element 53, diode 68 of time constant controlling circuit 64 remains non-conductive. Therefore, time constant controlling circuit 64 does not output the signal of light amount detecting circuit 62 to adjusting circuit 69 during the light detecting period. Additionally, light generated from light emitting diode 52 is not changed due to the insertion of print paper P, i.e. it does not disturb the detecting operation.

Operational amplifier 59 operates to displace the signal generated by buffer amplifier 58 by an amount corresponding to the thickness of print paper P. The signal is input to CPU 72 which in turn controls motor 13 to rotate guide shaft 7 to provide the most suitable gap for the thickness of print paper P. When the detecting operation is complete and light shutting plate 51 is released from distance measurement mechanism 54, light amount detecting circuit 62 operates in reverse so that diode 68 of time constant circuit 64 becomes conductive and the time constant is switched to a small time constant utilizing low resistor 67 and capacitor 66.

During this non-detecting period, when the output level of photosensitive element 53 is reduced by a change of voltage or deterioration of light element 52 and photosensitive element 53, light amount detecting circuit 62 outputs signals to correspond to a predetermined value of light amount setting resistor 63. This operates adjusting circuit 69 and transistor 70 which adjusts the current supplied to light emitting element 52 to compensate light emitting element 52. The output of photosensitive element 53 is kept uniform regardless of the deterioration of elements 52 and 53 because it is possible to prevent lapses over time.

By providing a printer having a lever member which selectively contacts the surface of the platen at one end, and is connected at its other end to a measuring device which provides an input to a control circuit for controlling the carriage guide shaft in response to the signal of the gap measuring device, and because the thickness of the print paper is detected based upon a fixed reference point coupled to the platen, it becomes possible to measure print paper thickness with higher accuracy and provide a reliable mechanism for adjusting the gap between the platen and print head. Additionally, because the paper thickness detector is mounted on a frame base or substrate having a broad area, it is no longer necessary to make the detector smaller thus simplifying assembly.

Additionally, a paper thickness detector which includes light emitting and photosensitive elements and detecting the difference between the signal generated by the paper thickness detector and a reference value and inputting this to a circuit for controlling a time constant so as to become larger during the detecting operation and to become smaller upon completion of the detecting operation, a circuit for adjusting the power supplied to the light emitting element in response to the signal of a light value detecting circuit which outputs through the time constant controlling circuit, the amount of light detected changes in accordance with the distance between the platen and lever member. Accordingly, the thickness of print paper is converted to a light value sensed regardless of print paper quality so that the thickness of the print paper is measured substantially in proportion to the amount of light making it possible to broaden the measuring range of thickness of the print paper.

By constructing time constant and controlling circuits in accordance with the invention it is possible to change the amount of light in accordance with the thickness of the print paper without requiring an operating circuit for automatically adjusting the amount of light during the detection operation. Additionally, immediately after the completion of the detecting operation, the means for automatically adjusting the amount of light is promptly restored to be ready for the next detection operation.

It will thus be seen that the objects set forth above, among those made apparent from the preceding description, are efficiently attained and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which as a matter of language might be said to fall therebetween.

What is claimed is:

1. A mechanism for automatically adjusting a gap between a platen and a print head in a printer for printing on a print medium comprising:

a frame having side walls and a base;

a carriage guide means for carrying a print head mounted between said frame walls and for adjusting the relative position between the carriage and the platen;

a carriage mounted for reciprocal displacement on said carriage guide means, the print head being mounted on the carriage;

a print medium thickness detecting lever pivotably mounted on said base adjacent to the platen with one end of the lever selectively contacting one of said platen and said print medium;

a print medium detecting lever;

print medium presence detecting means for detecting whether the print medium is within said printer in response to the position of the print medium detecting lever and providing a print medium presence detecting signal corresponding to the presence of the print medium;

print medium thickness detecting means for detecting the distance between said platen and said print medium thickness detecting lever in response to the position of said lever and providing a print medium thickness detecting signal corresponding thereto in response to said paper presence signal; and carriage control means for controlling said carriage guide means in response to said print medium detecting signal whereby said carriage guide adjusts the relative position between the carriage and platen to a suitable distance for printing base on the thickness of the print medium.

2. The mechanism for automatically adjusting a gap between a platen and print head in a printer of claim 1, wherein said carriage guide means is an eccentric shaft.

3. The mechanism for automatically adjusting the gap between a platen and print head in a printer of claim 1, wherein said print medium thickness detecting means includes pressure sensitive means for providing said signal in response to pressure applied by said lever to said thickness detecting means.

4. The mechanism for automatically adjusting a gap between a platen and a print head in a printer of claim 1, wherein said paper thickness detecting means includes a light emitting element, and a photosensitive element for receiving light emitted thereby, and the amount of light received by said photosensitive element varies in response to the position of the lever in accordance with the distance between said platen and said lever and the photo sensitive element providing the signal corresponding thereto.

5. The mechanism for automatically adjusting a gap between a platen and a print head in a printer of claim 1, wherein said carriage control means includes a first memory means for storing the signal output by said thickness detecting means as a reference signal when said lever contacts said platen, a second memory means for storing the signal produced by said paper thickness detecting means when said lever contacts a print medium on said platen; detector means for detecting the presence of print medium within said printer; motor means for adjusting said carriage guide means; processing means for receiving said signal stored in said first memory means and said signal stored in said second memory means and in response thereto producing a carriage adjustment signal for driving said motor means, whereby said motor means adjusts said carriage guide means to adjust the relative position between said carriage and said platen.

6. The mechanism for automatically adjusting a gap between a platen and a print head in a printer of claim 1, further including lever control means for controlling movement of said lever relative to said platen.

7. The mechanism for automatically adjusting a gap between a platen and a print head in a printer of claim 6, wherein said lever is pivotably mounted on said base and said lever control means includes a solenoid and a plunger driven by said solenoid, said lever being affixed to said plunger whereby said solenoid causes one portion of said lever to pivot towards or away from said platen.

8. The mechanism for automatically adjusting a gap between a platen and a print head in a printer of claim 5, further including lever control means for controlling movement of said print medium thickness detecting lever relative to said platen.

9. The mechanism for automatically adjusting a gap between a platen and a print head in a printer of claim 6, wherein said lever control means comprises a solenoid and a plunger, said print medium thickness detecting lever being affixed to said plunger whereby said solenoid causes a part of said lever to pivot towards or away from said platen.

10. The mechanism for automatically adjusting a gap between a platen and print head in a printer of claim 5, wherein said processing means provides a signal for driving said solenoid.

11. The mechanism for automatically adjusting a gap between a platen and a print head in a printer of claim 1, wherein said print medium presence detecting lever is pivotably and depressibly mounted in the path of the print medium adjacent to said platen.

12. A device for detecting the thickness of a print medium in a printer, comprising:

a frame including side wall and a base;

a platen mounted in said frame;

a print medium detecting lever;

print medium presence detection means for detecting whether the print medium is within said printer in response to the position of said print medium detecting lever and producing a print medium detection signal in response thereto;

a print medium thickness detecting lever pivotally mounted on said base adjacent the platen with the lever selectively contacting said platen;

gap detecting means for detecting the thickness of the gap between said lever and said platen print medium thickness detecting lever in response to said print medium detection signal by generating a first reference signal when the lever contacts the platen and a second thickness signal when the lever contacts the print medium corresponding to the gap between the lever and the platen.

13. The device for detecting the thickness of a print medium in a printer of claim 12, wherein the detecting means includes light emitting means and photosensitive means optically coupled to said light emitting means, the amount of light being received by said light emitting means varying in response to the size of said gap, said light emitting means providing a signal in response to the amount of light received; difference detecting means for determining the amount of light corresponding to the difference between the signal generated from said gap detecting means and a reference signal corresponding to the signal produced by said gap detecting means when said lever contacts said platen and producing a signal corresponding to said detected amount.

14. The device for detecting the thickness of a print medium in a printer of claim 13, wherein the print medium thickness detecting means includes time constant controlling means for operating on said difference signals in accordance with time constants and controlling said time constants to become larger during the detecting operation of said gap detecting means and become smaller at the completion of said detecting operation; and power adjusting means for adjusting the power supplied to said light emitting means in response to the signal output from said time constant controlling means.

15. A device for detecting the thickness of a print medium in a printer of claim 12 wherein said print medium thickness detecting means includes pressure sensitive means for providing said signal in response to pressure applied by said print medium thickness detecting lever to said thickness detecting means.

16. The mechanism for automatically adjusting a gap between a platen and a print head of claim 1, wherein said print medium presence detecting means outputs a signal for feeding a print medium to an initial printing position.

17. The mechanism for automatically adjusting a gap between a platen and a print head in a printer of claim 1, wherein said print medium presence detecting lever is pivotably and depressibly mounted in the path of the print medium adjacent to said platen.

* * * * *